US011682356B2

(12) United States Patent
Liu

(10) Patent No.: US 11,682,356 B2
(45) Date of Patent: Jun. 20, 2023

(54) DRIVING METHOD, DRIVING CIRCUIT, AND DISPLAY DEVICE

(71) Applicants: HUIZHOU CHINA STAR OPTOELECTRONICS DISPLAY CO., LTD., Guangdong (CN); TCL CHINA STAR OPTOELECTRONICS TECHNOLOGY CO., LTD., Guangdong (CN)

(72) Inventor: Jinfeng Liu, Guangdong (CN)

(73) Assignees: HUIZHOU CHINA STAR OPTOELECTRONICS DISPLAY CO., LTD., Guangdong (CN); TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 177 days.

(21) Appl. No.: 17/413,979

(22) PCT Filed: Apr. 30, 2021

(86) PCT No.: PCT/CN2021/091430
§ 371 (c)(1),
(2) Date: Jun. 15, 2021

(87) PCT Pub. No.: WO2022/222178
PCT Pub. Date: Oct. 27, 2022

(65) Prior Publication Data

US 2022/0392413 A1 Dec. 8, 2022

(30) Foreign Application Priority Data

Apr. 20, 2021 (CN) ..... 202110424367.6

(51) Int. Cl.
*G09G 3/34* (2006.01)
*G09G 3/20* (2006.01)

(52) U.S. Cl.
CPC ..... *G09G 3/3406* (2013.01); *G09G 3/2022* (2013.01)

(58) Field of Classification Search
CPC ..... G09G 3/3406; G09G 3/2022
See application file for complete search history.

(56) References Cited

U.S. PATENT DOCUMENTS 5,912,651 A * 6/1999 Bitzakidis ..... G09G 3/3406 348/E3.015
6,028,587 A * 2/2000 Igari ..... G09G 3/3674 345/597

(Continued)

FOREIGN PATENT DOCUMENTS

CN 101339749 A 1/2009
CN 102054434 A 5/2011

(Continued)

*Primary Examiner* — Benyam Ketema
(74) *Attorney, Agent, or Firm* — Mark M. Friedman

(57) ABSTRACT

The present disclosure discloses a driving method, a driving circuit, and a display device. The driving method includes: acquiring driving data that includes N-bit data; dividing the N-bit data into M groups of sub-bit data in sequence, wherein each group of the sub-bit data includes (N/M)-bit data, M is a positive divisor of N, and M is not 1 or N; and driving, by adopting a corresponding driving voltage and corresponding driving time, a corresponding light-emitting unit to emit light, according to each group of the sub-bit data.

20 Claims, 4 Drawing Sheets

(56) References Cited

U.S. PATENT DOCUMENTS 7,518,622 B2 * 4/2009 Ochi ..... G09G 3/2077 345/100
7,808,510 B2 * 10/2010 Miyasaka ..... H04N 19/86 345/596
8,432,502 B2 * 4/2013 Yamazaki ..... G02F 1/1368 349/44
8,970,617 B2 * 3/2015 Lim ..... G02B 30/25 348/51
10,140,908 B2 * 11/2018 Kuo ..... G09G 3/32
10,475,402 B2 * 11/2019 Nakahara ..... G09G 3/36
10,607,550 B2 * 3/2020 Zhou ..... G09G 3/3258
2004/0012580 A1 * 1/2004 Yamagishi ..... G09G 3/3696 345/204
2005/0105818 A1 * 5/2005 Hoshi ..... G06T 5/003 382/254
2008/0297524 A1 * 12/2008 Huang ..... G09G 3/3648 345/530
2009/0009538 A1 * 1/2009 Nakamura ..... G09G 3/3688 345/690
2011/0050741 A1 * 3/2011 Jeong ..... G09G 3/3291 345/82
2011/0261263 A1 10/2011 Schoenfeld
2011/0298789 A1 * 12/2011 Ko ..... H04N 13/144 345/419
2012/0146995 A1 * 6/2012 Lee ..... G09G 5/393 345/419
2012/0154428 A1 * 6/2012 Barnhoefer ..... G06T 11/001 382/167
2012/0274628 A1 * 11/2012 Lim ..... H04N 13/356 345/419
2015/0213575 A1 * 7/2015 Ota ..... G09G 3/36 345/591
2017/0270850 A1 * 9/2017 Pappas ..... G09G 3/2077
2019/0279577 A1 * 9/2019 Zhou ..... G09G 3/003
2021/0027699 A1 * 1/2021 Zheng ..... G09G 3/32
2021/0097931 A1 * 4/2021 Yue ..... G09G 3/3283
2021/0225262 A1 * 7/2021 Liu ..... G09G 3/2022

FOREIGN PATENT DOCUMENTS

CN 102243842 A 11/2011
CN 104680986 A 6/2015
CN 107205293 A 9/2017
CN 107731145 A 2/2018
CN 108447444 A 8/2018
CN 110831279 A 2/2020
CN 111445868 A 7/2020
CN 111554239 A 8/2020
CN 111798804 A 10/2020
CN 112017603 A 12/2020
JP 2002040983 A 2/2002

* cited by examiner

DRIVING METHOD, DRIVING CIRCUIT, AND DISPLAY DEVICE

FIELD OF INVENTION

The present disclosure relates to the field of display, in particular, to a driving method, a driving circuit and a display device.

BACKGROUND OF INVENTION

An active-matrix (AM) mini-light-emitting diode (Mini-LED) backlight driving method has become the backlight trend of liquid crystal display (LCD) panels due to the advantages such as local controllability, a small number of LED driver chips, and low cost.

However, adopting the AM Mini-LED backlight driving method means that charging time of each area of the backlight is short, and the charging time decreases with the increase of grayscale levels of the backlight. Also, because of a certain voltage drop of the backlight panel, when charging the panel, a certain rise and fall time are required. In order to meet charging requirements, the charging time of the Mini-LED backlight has a minimum limit, so the grayscale levels are limited by the charging time. As the market has higher and higher requirements for the brightness of the grayscale of the backlight, current backlight control technology is difficult to meet the requirements of high-level backlight for the depth of the grayscale.

SUMMARY OF INVENTION

Embodiments of the present disclosure provide a driving method, a driving circuit, and a display device, which can increase the number of gray levels of a light-emitting unit, increase brightness depth of the light-emitting unit, and meet requirements of high-level light emission for grayscale depth.

An embodiment of the present disclosure provides a driving method, and the driving method includes the following steps:

acquiring driving data that includes N-bit data;

dividing the N-bit data into M groups of sub-bit data in sequence, wherein each group of the sub-bit data includes (N/M)-bit data, M is a positive divisor of N, and M is not 1 or N; and driving, by adopting a corresponding driving voltage and corresponding driving time, a corresponding light-emitting unit to emit light, according to each group of the sub-bit data.

Optionally, in some embodiments of the present disclosure, the step of dividing the N-bit data into M groups of sub-bit data in sequence includes:

dividing each (N/M)-bit data in the N-bit data into one group of sub-bit data in order of bits from high to low; and sequentially denoting each of the divided groups of sub-bit data as first-level sub-bit data, second-level sub-bit data, . . . , and Mth-level sub-bit data.

Optionally, in some embodiments of the present disclosure, the driving time corresponding to the sub-bit data is shorter as a level corresponding to the sub-bit data is larger.

Optionally, in some embodiments of the present disclosure, the driving time corresponding to the first-level sub-bit data, the second-level sub-bit data, . . . , and the Mth-level sub-bit data are respectively P1, P2, . . . , and PM, and wherein P1, P2, . . . , and PM satisfy as:

$$P1:P2:\ldots:PM=2^{(M-1)}:2^{(M-2)}:\ldots:2^{0}.$$

Optionally, in some embodiments of the present disclosure, a sum of the driving time corresponding to the M groups of the sub-bit data is time of M frames.

Optionally, in some embodiments of the present disclosure, one of the groups of the sub-bit data corresponds to one of the driving voltage.

Optionally, in some embodiments of the present disclosure, the sub-bit data is selected from one of $2^{(N/M)}$ different data, and wherein the driving voltage corresponding to the sub-bit data is selected from one of $2^{(N/M)}$ driving voltages with different potentials.

Optionally, in some embodiments of the present disclosure, the potential of the driving voltage corresponding to the sub-bit data is higher as a binary value formed by (N/M) sub-bit of the sub-bit data is larger.

Correspondingly, an embodiment of the present disclosure further provides a driving circuit for implementing each step in the driving method of the embodiment of the present disclosure, wherein the driving circuit comprises a voltage output module and a light-emitting module, an output terminal of the voltage output module is connected to a driving voltage input terminal of the light-emitting module to output a corresponding driving voltage to the light-emitting module according to driving data that comprises N-bit data, and the voltage output module includes:

$2^{(N/M)}$ output branches, in which an output terminal of any one of the output branches is connected to the driving voltage input terminal of the light-emitting module, and different output branches are configured to input different driving voltages to the light-emitting module, wherein M is a positive divisor of N and M is not 1 or N.

Optionally, in some embodiments of the present disclosure, the voltage output module includes at least one original voltage input terminal, and the output branches are electrically connected to the original voltage input terminal.

Optionally, in some embodiments of the present disclosure, a quantity of the original voltage input terminals is only one, and the output branches include a first output branch, a second output branch, . . . , and a $2^{(N/M)}$th output branch, wherein the first output branch is directly connected to the original voltage input terminal, the second output branch is connected to the original voltage input terminal via a first resistor, . . . , and the $2^{(N/M)}$th output branch is connected to the original voltage input terminal via a series circuit of a $(2^{(N/M)}-1)$-th resistor, . . . , a second resistor and the first resistor and is grounded.

Optionally, in some embodiments of the present disclosure, the quantity of the original voltage input terminals is $2^{(N/M)}$; the original voltage input terminals include a first original voltage input terminal, a second original voltage input terminal, . . . , and a $2^{(N/M)}$th original voltage input terminal; the output branches include a first output branch, a second output branch, . . . , and a $2^{(N/M)}$th output branch; the first output branch is directly connected to the first original voltage input terminal; the second output branch is directly connected to the second original voltage input terminal, . . . ; and the $2^{(N/M)}$th output branch is directly connected to the $2^{(N/M)}$th original voltage input terminal.

Optionally, in some embodiments of the present disclosure, each of the output branches includes a switch control unit configured to control a conduction state of the output branch.

Optionally, in some embodiments of the present disclosure, the switch control unit is a DIP switch.

Optionally, in some embodiments of the present disclosure, the switch control unit comprises N/M switching transistors connected in series, one terminal of the switch control unit is electrically connected to the output terminal of the voltage output module, and the other terminal of the switch control unit is electrically connected to the original voltage input terminal.

Optionally, in some embodiments of the present disclosure, in any M/2 of the output branches, a gate of one of the switching transistors on each of the output branches is connected to a same gate control voltage.

Optionally, in some embodiments of the present disclosure, the light-emitting module includes a charging unit, a driving unit, an energy storage unit, and a light-emitting unit, the charging unit is electrically connected to the driving unit and the energy storage unit to write a data signal into the energy storage unit according to a scan signal;

the driving unit is electrically connected to the energy storage unit, the charging unit, and the light-emitting unit to drive the light-emitting unit to operate under control of the energy storage unit; and the energy storage unit is configured to store the data signal and control an operation state of the driving unit according to the data signal.

Correspondingly, an embodiment of the present disclosure further provides a display device including a driving circuit that includes a voltage output module and a light-emitting module, wherein an output terminal of the voltage output module is connected to a driving voltage input terminal of the light-emitting module to output a corresponding driving voltage to the light-emitting module according to driving data that comprises N-bit data, and the voltage output module includes:

$2^{(N/M)}$ output branches, in which an output terminal of any one of the output branches is connected to the driving voltage input terminal of the light-emitting module, and different output branches are configured to input different driving voltages to the light-emitting module, wherein M is a positive divisor of N and M is not 1 or N.

Optionally, in some embodiments of the present disclosure, the voltage output module includes at least one original voltage input terminal, and the output branches are electrically connected to the original voltage input terminal.

Optionally, in some embodiments of the present disclosure, each of the output branches comprises a switch control unit configured to control a conduction state of the output branch.

Embodiments of the present disclosure provide a driving method, a driving circuit, and a display device. The driving method includes: acquiring driving data that includes N-bit data; dividing the N-bit data into M groups of sub-bit data in sequence, wherein each group of the sub-bit data includes (N/M)-bit data, M is a positive divisor of N, and M is not 1 or N; and driving, by adopting a corresponding driving voltage and corresponding driving time, a corresponding light-emitting unit to emit light, according to each group of the sub-bit data. The present disclosure divides raw N-bit data into M groups of sub-bit data, and uses the corresponding driving voltage and driving time to drive the light-emitting unit according to each sub-bit data. The manner of original grayscale display is converted to be divided into M types of grayscale display to increase the number of gray levels of the light-emitting units, to increase brightness depth of the light-emitting units, and to meet requirements of high-level lighting for the grayscale depth.

BRIEF DESCRIPTION OF DRAWINGS

The technical solutions and other beneficial effects of the present disclosure will be obvious by describing the specific implementation manners of the present disclosure in detail below in conjunction with the accompanying drawings.

DETAILED DESCRIPTION OF PREFERRED EMBODIMENTS

Embodiments of the present disclosure provide a driving method, a driving circuit, and a display device to increase the number of gray levels of light-emitting units, to increase brightness depth of the light-emitting unit, and to meet requirements of high-level light emission for the grayscale depth. Detailed descriptions are given below. It should be noted that the description order of the following embodiments is not intended to limit the preferred order of the embodiments.

Figure 1:
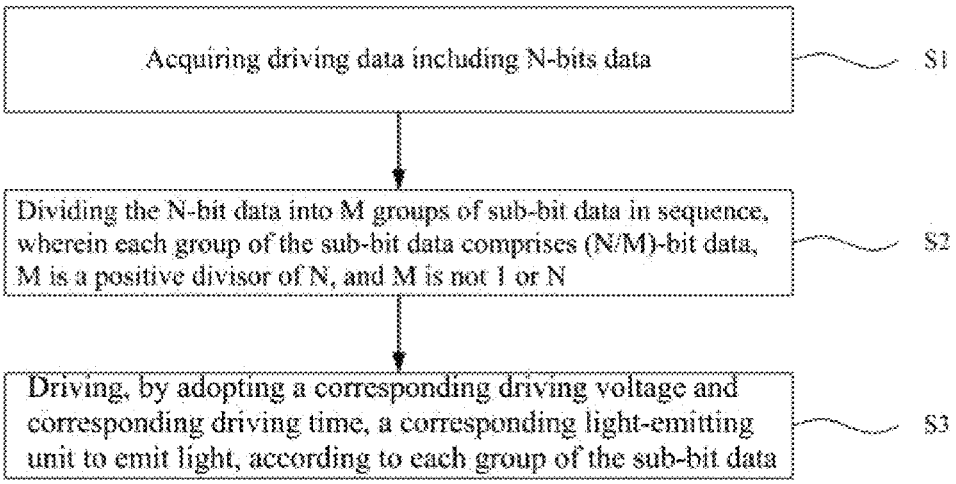
FIG. 1 is a flowchart of a driving method provided by an embodiment of the present disclosure.

In an embodiment, please refer to FIG. 1, which shows a flowchart of a driving method provided in an embodiment of the present disclosure. As shown in the figure, the driving method provided by the embodiment of the present disclosure includes:

Step S1: acquiring driving data that includes N-bit data.

Specifically, the driving data is acquired from a time controller (Tcon) or a field-programmable gate array (FPGA), and the driving data is binary data obtained by processing through an algorithm based on the data information of a frame to be displayed. The number of bits of the driving data determines the maximum grayscale level of a light-emitting unit. A relationship of a grayscale level G of the light-emitting unit and a bit number N of the driving data satisfies $G=2^N$. When the number of bits of the driving data is 8 bits, the light-emitting unit can emit light with 256 different brightness values, i.e., the brightness values corresponding to the grayscale values 0-255. In addition, when the number of bits of the driving data is 12 bits, the light-emitting unit can emit light with 4096 different brightness values, i.e., the brightness values corresponding to the grayscale values 0-4095. The N-bit data includes from 0th-bit data to (N−1)th-bit data, and each bit of data is either 0 or 1, wherein the 0th-bit is the smallest but the highest bit. The (N−1)th bit is the largest but lowest bit.

Step S2: dividing the N-bit data into M groups of sub-bit data in sequence, wherein each group of the sub-bit data comprises (N/M)-bit data, M is a positive divisor of N, and M is not 1 or N.

Specifically, dividing each (N/M)-bit data in the N-bit data into one group of sub-bit data in order of bits from high to low, and sequentially denoting each of the divided groups of sub-bit data as first-level sub-bit data, second-level sub-bit data, . . . , and Mth-level sub-bit data. For example, the data from 0th-bit to (N/M−1)th-bit is divided into a first group of sub-bit data that is denoted as the first-level sub-bit data; the data from the (N/M)th-bit to (2N/M−1)th-bit is divided into a second group of sub-bit data that is denoted as the second-level sub-bit data; and so on, to the Mth-level sub-bit data. In which, the level of the first-level sub-bit data is the highest, and the level of the Mth-level sub-bit data is the lowest.

Step S3: driving, by adopting a corresponding driving voltage and corresponding driving time, a corresponding light-emitting unit to emit light, according to each group of the sub-bit data.

Each group of sub-bit data corresponds to a drive voltage with a specific potential. Because each group of sub-bit data includes (N/M)-bit data and each bit of data is selected from any one of 0 and 1, there are correspondingly ($2^{N/M}$) possibilities of sub-bit data. Therefore, the driving voltage corresponding to the sub-bit data has ($2^{N/M}$) different potentials. If two sub-bit data are the same, that is, the number and order of 0 and 1 in the two sub-bit data are the same, then the driving voltages corresponding to both of the bit data are the same. If the two sub-bit data are not the same, that is, one of the number and order of 0 and 1 in the two sub-bit data are the same, then the driving voltages corresponding to both of the bit data are different. The driving method provided in the present embodiment divides raw bit data into M groups of sub-bit data and uses ($2^{N/M}$) types of driving voltages with different potentials to drive the light-emitting unit. The number of grayscale levels of the light-emitting unit is changed from a single original fixed type to be divided into the ($2^{N/M}$) types herein. It can increase the number of grayscale levels of the light-emitting unit and increase the brightness depth of the light-emitting unit.

Further, in an embodiment of the present disclosure, the potential of the driving voltage corresponding to the sub-bit data is higher as a binary value formed by (N/M) sub-bit of the sub-bit data is larger. For example, if the binary value formed by the sub-bit data (11) is 11, and the binary value formed by the sub-bit data (10) is 10, then the potential of the driving voltage corresponding to the sub-bit data (11) is greater than the potential of the driving voltage corresponding to the sub-bit data (10). Because the binary value formed by bit data increases, the number of grayscale levels corresponding to the bit data increases. For example, 8-bit data (00000000) corresponds to the 0th grayscale, 8-bit data (01111111) corresponds to the 127th grayscale, and 8-bit data (11111111) corresponds to the 255th grayscale. If the number of grayscale levels increases, then the corresponding luminous brightness increases. That is, for the sub-bit data of the same level, if the binary value formed by the sub-bit data increases, then the corresponding driving voltage increases, and the corresponding light-emitting brightness is brighter. In the present embodiment, the size of the binary value formed by the sub-bit data is combined with the potential of the drive voltage, and then the drive voltage is combined with the light-emitting brightness, and the sub-bit data with a larger binary value is formed by combining the size of the drive voltage corresponding to the sub-bit data. The higher potential highlights a weight difference of different sub-bit data in the brightness, thereby improving the contrast of different grayscale values, and further improving the brightness depth of the light-emitting unit.

Each group of sub-bit data corresponds to a driving time. The sum of the driving time corresponding to the M groups of sub-bit data is the time of M frames. That is, complete N-bit data uses the time of M frames as a time unit for driving. In the present embodiment, the time of M frames is used as a time unit to drive the N-bit data, which ensures that the light-emitting unit has sufficient charging time, so that the number of grayscale levels is no longer limited by the charging time, thereby improving the number of grayscale levels of the light-emitting unit and the brightness depth of the light-emitting unit.

Further, the driving time corresponding to the sub-bit data with the same level is the same, and the driving time corresponding to the sub-bit data of different levels is different. As the level of the sub-bit data is higher, then the driving time corresponding to the sub-bit data is longer. Denoting that the driving time corresponding to the first-level sub-bit data, the second-level sub-bit data, . . . , and the M-th level sub-bit data are respectively P1, P2, . . . , and PM, respectively, wherein P1, P2, . . . , and PM satisfy as P1: P2: . . . :PM=$2^{(M-1)}$: $2^{(M-2)}$: . . . :$2^0$. Because the bit of the bit data is higher, the impact on the number of grayscale levels is greater. For example, 8-bit data (00000000) corresponds to the 0th grayscale, 8-bit data (00000001) corresponds to the 1st grayscale, 8-bit data (01111111) corresponds to the 127th grayscale, and 8-bit data (11111111) corresponds to the 255th grayscale. In the present embodiment, by setting the driving time corresponding to the sub-bit data with a higher level to be longer, the weight difference of different sub-bit data in the brightness is further highlighted, thereby improving the contrast of different grayscale levels and further improving the brightness depth of the light-emitting unit.

In an embodiment, the present disclosure provides a driving circuit for implementing steps S1-S3 in the driving method provided in the embodiment of the present disclosure. Please refer to FIGS. 3 and 4, which show two circuit diagrams of the driving circuit provided by the embodiment of the present disclosure, respectively. As shown in the figure, the driving circuit provided by the embodiment of the present disclosure includes a voltage output module 30 and a light-emitting module 40. An output terminal of the voltage output module 30 is connected to a driving voltage input terminal of the light-emitting module 40 to output a corresponding driving voltage to the light-emitting module 40 according to the driving data. The driving data includes N-bit data. The voltage output module 30 includes 2(N/M) output branches, the output terminal of any output branch is connected to the driving voltage input terminal of the light-emitting module 40, wherein different output branches are used to output different driving voltages to the light-emitting module 40, wherein M is a positive divisor of N and M is not 1 or N.

The driving circuit provided in the present embodiment is used to output $2^{(N/M)}$ different driving voltages to the light-emitting module by adding the voltage output module with $2^{(N/M)}$ output branches. $2^{(N/M)}$ driving voltages with different potentials are adopted to drive the light-emitting unit. The driving voltage of the light-emitting unit is changed from the original one type to $2^{(N/M)}$ types herein, and the corresponding number of grayscale levels is correspondingly increased to $2^{(N/M)}$ levels, which improves the number of grayscale levels of the light-emitting unit and improves the brightness depth of the light-emitting unit.

Figure 3:
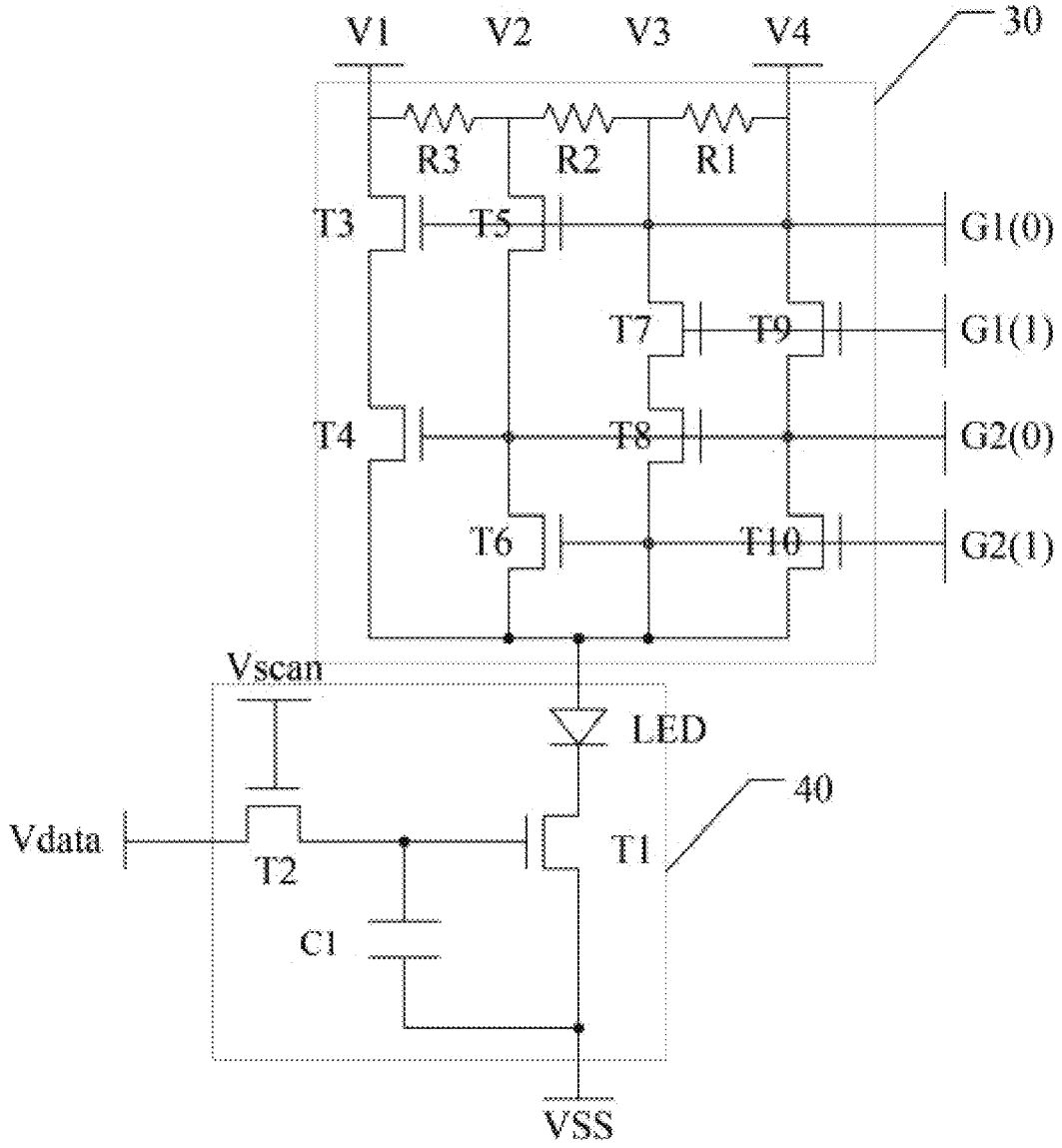
FIG. 3 is a first circuit diagram of a driving circuit provided by an embodiment of the present disclosure.
Figure 4:
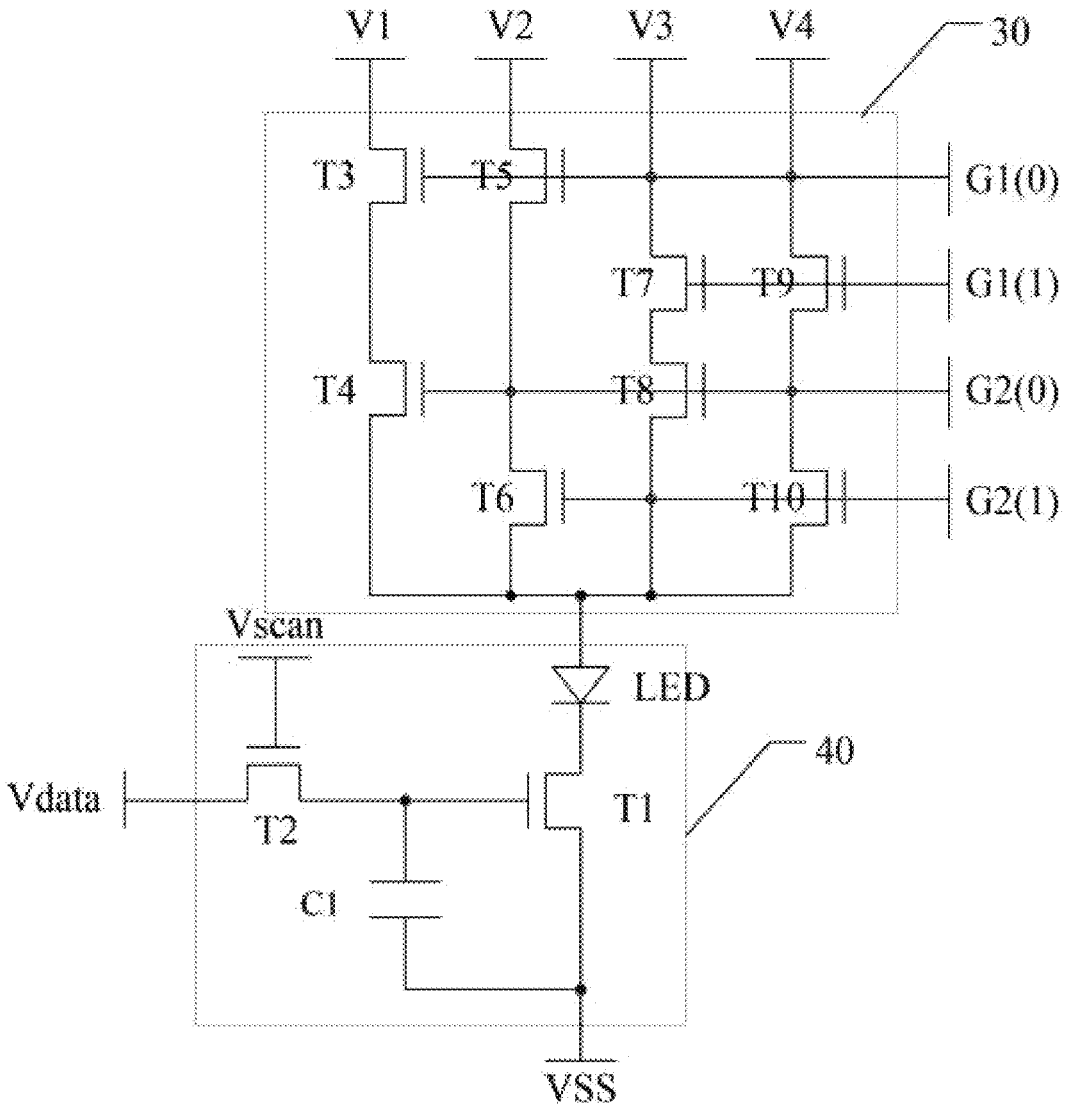
FIG. 4 is a second circuit diagram of the driving circuit provided by the embodiment of the present disclosure.

In an embodiment, the voltage output module 30 includes at least one original voltage input terminal, and each output branch is electrically connected to the original voltage input terminal. In an embodiment, as shown in FIG. 3, there is only one original voltage input terminal. The output branches include a first output branch, a second output branch, . . . , and a $2^{(N/M)}$th output branch. The first output branch is directly connected to the original voltage input terminal; the second output branch is connected to the original voltage input terminal via a first resistor; . . . ; and the $2^{(N/M)}$th output branch is connected to the original voltage input terminal via a series circuit of the $((2^{(N/M)}-1)$-th resistor, . . . , a second resistor, and the first resistor, and is grounded. In another embodiment, as shown in FIG. 4, there are $2^{(N/M)}$ original voltage input terminals that include a first original voltage input terminal, a second original voltage input terminal, . . . , and a $2^{(N/M)}$th original voltage input terminal. The output branches include a first output branch, a second output branch, . . . , and a $2^{(N/M)}$th output branch. The first output branch is directly connected to the first original voltage input terminal; the second output branch is directly connected to the second original voltage input terminal; . . . ; and the $2^{(N/M)}$th output branch is directly connected to the $2^{(N/M)}$th original voltage input terminal.

In an embodiment, each of output branches includes a switch control unit for controlling the conduction of the output branch. In one embodiment, the switch control unit is a DIP switch. In another embodiment, the switch control unit includes N/M switching transistors connected in series. One terminal of the switch control unit is electrically connected to an output terminal of the voltage output module. The other terminal is electrically connected to the original voltage input terminal. In addition, a gate of one switching transistor on any one of the output branches is electrically connected to a gate of one switching transistor on the other (M/2−1) output branches and is connected to a gate control voltage but is not connected to gates of other switching transistors.

In an embodiment, the light-emitting module 40 includes a charging unit, a driving unit, an energy storage unit, and a light-emitting unit. The charging unit is electrically connected to the driving unit and the energy storage unit to write a data signal into the energy storage unit according to a scan signal. The driving unit is electrically connected to the energy storage unit, the charging unit, and the light-emitting unit to drive the light-emitting unit to operate under control of the energy storage unit. The energy storage unit is used for storing a data signal and controlling the operation state of the driving unit according to the data signal. Specifically, as shown in FIGS. 3 and 4, the driving unit is a first thin-film transistor T1. The charging unit is a second thin-film transistor T2. The energy storage unit is a capacitor C1. The light-emitting unit includes a subminiature light-emitting diode LED. A gate of the second thin-film transistor T2 is connected to a scan signal Vscan. A first terminal of the second thin-film transistor T2 is connected to the data signal Vdata. A second terminal of the second thin-film transistor T2 is connected to a gate of the first thin-film transistor T1 and a first terminal of the capacitor C1. The first terminal of the first thin-film transistor T1 is connected to an output terminal of the light-emitting unit LED. A second terminal of the first thin-film transistor T1 is connected to a second terminal of the capacitor C1 and is connected to a ground signal VSS. An input terminal of the light-emitting unit LED is connected to the output terminal of the voltage output module 30.

The driving method and driving circuit provided by the embodiments of the present disclosure will be described in detail below in conjunction with specific embodiments, and an 8-bit data backlight is taken as an example.

Figure 2:
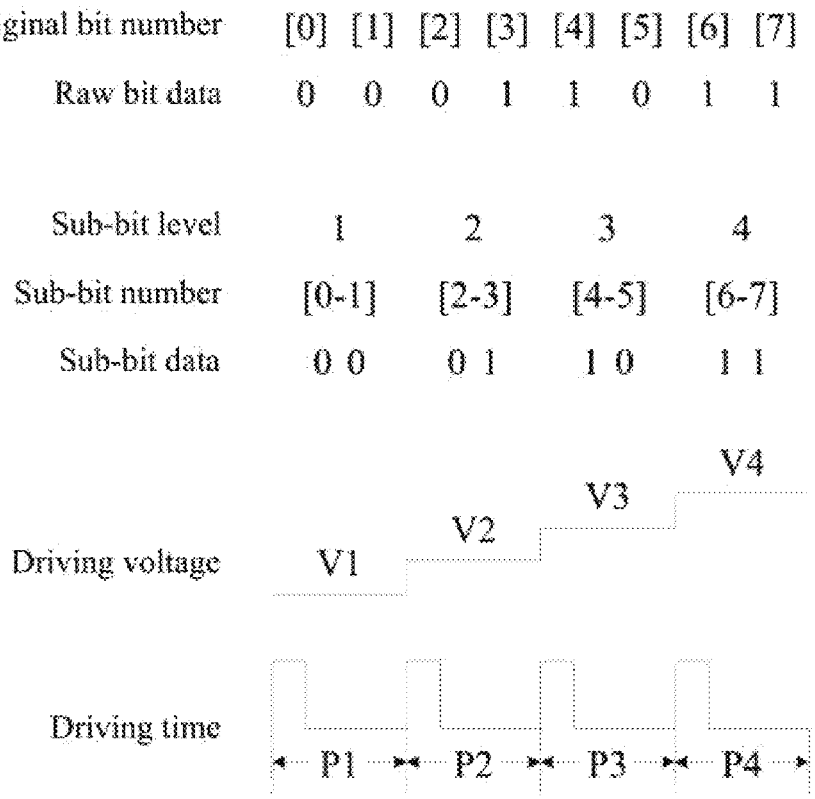
FIG. 2 is a schematic diagram of a driving method provided by an embodiment of the present disclosure.

Please refer to FIG. 2, which shows a schematic diagram of a driving method provided by an embodiment of the present disclosure.

In the present embodiment, 8-bit drive data provided by a front-end timing controller Tcon or an FPGA is B=00011011, wherein the 0th bit of data B[0]=0, the 1st bit of data B[1]=0, the 2nd bit of data B[2]=0, the 3rd bit of data B[3]=1, the 4th bit of data B[4]=1, the 5th bit of data B[5]=0, the 6th bit of data B[6]=1, the 7th bit of data B[7]=1. In which, B[0] is the highest bit of data, B[7] is the lowest bit of data.

According to the order of bits from high to low, each 2-bit data in the original 8-bit data is divided into a group of sub-bit data, that is, the original 8-bit data is divided into four groups of 2-bit data, for example, B[0-1]=00, B[2-3]=01, B[4-5]=10, B[6-7]=11. Also, the first group of sub-bit data B[0-1] is denoted as first-level sub-bit data, the second group of sub-bit data B[2-3] is denoted as second-level sub-bit data, the third group of sub-bit data B[4-5] is denoted as third-level sub-bit data, and the fourth group of sub-bit data B[6-7] is denoted as fourth-level sub-bit data. In which, The level of the first-level sub-bit data B[0-1] is the highest, the level of the second-level sub-bit data B[2-3] is the second-highest, the level of the third-level sub-bit data B[4-5] is the second-lowest, and the level of the fourth-level sub-bit data B[6-7] is the lowest.

The divided 2-bit data has four different types of choices, i.e., 00, 01, 10, and 11. Each type of 2-bit data corresponds to a specific driving voltage. For example, when the 2-bit data is 00, the corresponding driving voltage is V1; when the 2-bit data is 01, the corresponding driving voltage is V2; when the 2-bit data is 10, the corresponding driving voltage is V3; and when the 2-bit data is 11, the corresponding driving voltage is V4. That is, the driving voltage of the sub-bit data B[0-1] is V1, the driving voltage of the sub-bit data B[2-3] is V2, the driving voltage of the sub-bit data B[4-5] is V3, and the driving voltage of the sub-bit data B[6-7] is V4. In which, the potential of the driving voltage V4 is greater than the potential of the driving voltage V3, the potential of the driving voltage V3 is greater than the potential of the driving voltage V2, the potential of the driving voltage V2 is greater than the potential of the driving voltage V1, and the potential of the driving voltage V1 is preferably ground potential.

The divided groups of sub-bit data are driven in an independent driving manner, and the driving time corresponding to the sub-bit data with different levels is different. As shown in the figure, the driving time of the first-level sub-bit data B[0-1] is P1, the driving time of the second-level sub-bit data B[2-3] is P2, the driving time of the third-level sub-bit data B[4-5] is P3, and the driving time of the fourth-level sub-bit data B [6-7] is P4, wherein P1, P2, P3, and P4 satisfy as P1: P2: P3: P4=$2^3$:$2^2$:$2^1$:$2^0$, and P1+P2+P3+P4=one time unit (time of 4 frames).

As shown in FIG. 3, the voltage output module 30 includes an original voltage input terminal connected to an original input voltage V4 and further includes a ground terminal connected to a ground voltage V1. The original voltage input terminal and the ground terminal are connected in series via a first resistor R1, a second resistor R2, and a third resistor R3. The first output branch includes switching transistors T9 and T10 connected in series and is directly connected to the original voltage input terminal and an input terminal of a driving module 40. The second output branch includes switching transistors T7 and T8 connected in series, the second output branch is connected to the original voltage input terminal via the first resistor R1, and the second output branch is directly connected to the input terminal of the driving module 40. The third output branch includes switching transistors T5 and T6 connected in series, the third output branch is connected to the original voltage input terminal via the first resistor R1 and the second resistor R2, and the third output branch is directly connected to the input terminal of the driving module 40. The fourth output branch includes switching transistors T3 and T4 connected in series, the fourth output branch is connected to the original voltage input terminal via the first resistor R1, the second resistor R2, and the third resistor R3 and is grounded, and the fourth output branch is also directly connected to the input terminal of the driving module 40. A gate of the switching transistor T3 is connected to a gate of the switching transistor T5 and a first gate control voltage G1(0) corresponding to first-bit data 0 of 2-bit data. A gate of the switching transistor T7 is connected to a gate of the switching transistor T9 and a second gate control voltage G1(1) corresponding to first-bit data 1 of 2-bit data. A gate of the switching transistor T4 is connected to a gate of the switching transistor T8 and a third gate control voltage G2(0) corresponding to second-bit data 0 of 2-bit data. A gate of the switching transistor T6 is connected to a gate of the switching transistor T10 and a fourth gate control voltage G2(1) corresponding to second-bit data 1 of 2-bit data.

As shown in FIG. 4, the voltage output module 30 includes four original voltage input terminals, which are respectively connected to a first original input voltage V1, a second original input voltage V2, a third original input voltage V3, and a fourth original input voltage V4. The first original input voltage V1 is a ground voltage. One terminal of the first output branch is directly connected to the fourth original voltage V4, and the other terminal is directly connected to the input terminal of the driving module 40. One terminal of the second output branch is directly connected to the third original voltage V3, and the other terminal is directly connected to the input terminal of the driving module 40. One terminal of the third output branch is directly connected to the second original voltage V2, and the other terminal is directly connected to the input terminal of the driving module 40. One terminal of the fourth output branch is directly connected to the first original voltage V1, and the other terminal is directly connected to the input terminal of the driving module 40.

In the process of using the driving voltage and driving time shown in FIG. 2 to drive the light-emitting unit LED, for the first-level sub-bit data B[0-1]=00, the switching transistor T3 and the switching transistor T4 are turned on, the voltage output module 30 inputs the driving voltage V1 to the driving module via the fourth output branch to drive the light-emitting unit LED to emit light during the driving time P1; for the second-level sub-bit data B[2-3]=01, the switching transistor T5 and the switching transistor T6 are turned on, and the voltage output module 30 inputs the driving voltage V2 to the driving module via the third output branch to drive the light-emitting unit LED to emit light during the driving time P2; for the third-level sub-bit data B[4-5]=10, the switching transistor T7 and the switching transistor T8 are turned on, and the voltage output module 30 inputs the driving voltage V3 to the driving module via the second output branch to drive the light-emitting unit LED to emit light during the driving time P3; and for the fourth level sub-bit data B[6-7]=11, the switching transistor T9 and the switching transistor T10 are turned on, the voltage output module 30 inputs the driving voltage V4 to the driving module via the first output branch to drive the light-emitting unit LED to emit light during the driving time P4.

Figure 5:
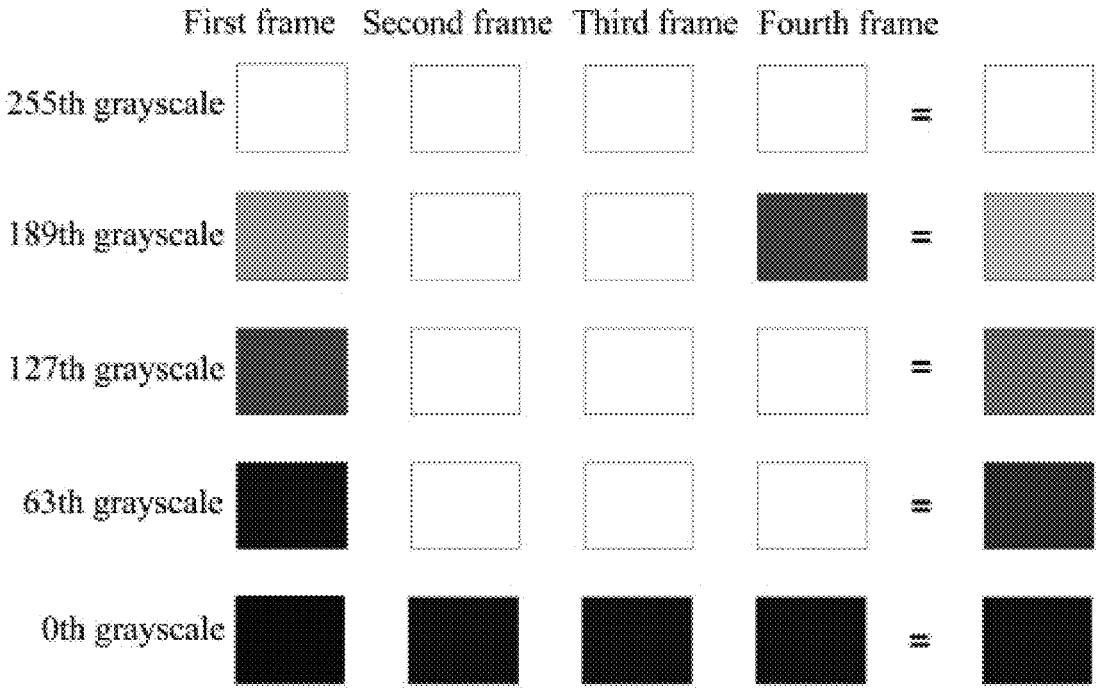
FIG. 5 is a schematic diagram of effects of the driving method provided by the embodiment of the present disclosure.

The driving time P1 is denoted as a new first-frame time, the driving time P2 is denoted as a new second-frame time, the driving time P3 is denoted as a new third-frame time, and the driving time P4 is denoted as a new fourth-frame time. Please refer to FIG. 5, which shows a schematic diagram of the effect of the driving method provided by an embodiment of the present disclosure. As shown in the figure, 8-bit data B(0)=00000000 corresponding to 0th grayscale level, the corresponding 2-bit data B[0-1]=00, B[2-3]=00, B[4-5]=00, and B[6-7]=00. The driving voltage V1 drives the display unit LED during the first-frame time P1 to displays the grayscale corresponding to the first-level 2-bit data B[0-1]. The driving voltage V1 drives the display unit LED during the second-frame time P2 to display the grayscale corresponding to the second-level 2-bit data B[2-3]. The driving voltage V1 drives the display unit LED during the third-frame time P3 to displays the grayscale corresponding to the third-level 2-bit data B[4-5]. The driving voltage V1 drives the display unit LED during the fourth frame time P4 to display the grayscale corresponding to the fourth-level 2-bit data B[6-7]. Due to the hysteresis effect of the human eye and the high refresh level of the display device, the 4-frame grayscale display effect is superimposed on each other, which is equivalent to the display effect corresponding to 0th grayscale. Similarly, for 8-bit data B(63)=00111111, the driving voltage V1 drives the display unit LED during the 1st-frame time P1, the driving voltage V4 drives the display unit LED during the 2nd-frame time P2, the driving voltage V4 drives the display unit LED during the 3rd-frame time P3, and the driving voltage V4 drives the display unit LED during the 4th-frame time P4, in which display effects of grayscale of the 4 frames are superimposed on each other, and the display effect is finally equivalent to the display effect of 63rd grayscale. For 8-bit data B(127)=01111111, the drive voltage V2 drives the display unit LED during the 1st-frame time P1, the drive voltage V4 drives the display unit LED during the 2nd-frame time P2, the drive voltage V4 drives the display unit LED during the 3rd-frame time P3, and the driving voltage V4 drives the display unit LED during the 4th-frame time P4, in which display effects of grayscale of the 4 frames are superimposed on each other, and the display effect is finally equivalent to the display effect of 127th grayscale. For 8-bit data B(189)=10111101, the drive voltage V3 drives the display unit LED during the 1st-frame time P1, the drive voltage V4 drives the display unit LED during the 2nd-frame time P2, the drive voltage V4 drives the display unit LED during the 3rd-frame time P3, and the driving voltage V2 drives the display unit LED during the 4th-frame time P4, in which display effects of grayscale of the 4 frames are superimposed on each other, and the display effect is finally equivalent to the display effect of 189th grayscale. For 8-bit data B(255)=11111111, the drive voltage V1 drives the display unit LED during the 1st-frame time P1, the drive voltage V4 drives the display unit LED during the 2nd-frame time P2, the drive voltage V4 drives the display unit LED during the 3rd-frame time P3, and the driving voltage V4 drives the display unit LED during the 4th-frame time P4, in which display effects of grayscale of the 4 frames are superimposed on each other, and the display effect is finally equivalent to the display effect of 255th grayscale. In this way, by dividing raw 8-bit data into four groups of sub-bit data, according to each sub-bit data, the light-emitting unit is driven by the corresponding driving voltage and driving time. The manner of the original grayscale display is converted to be divided into four kinds of grayscale display, thereby increasing the number of grayscale levels of the light-emitting unit and increasing the brightness depth of the light-emitting unit.

Correspondingly, an embodiment of the present disclosure further provides a display device, which includes any of the driving circuits provided in the embodiments of the present disclosure and has the technical features and technical effects of any one of the driving circuits provided in the embodiment of the present disclosure, in which specific implementations and operating principles, will not be repeated here, please refer to the foregoing specific embodiments.

In summary, the embodiments of the present disclosure provide a driving method, a driving circuit, and a display device. The driving method includes the following steps: acquiring driving data that includes N-bit data; dividing the N-bit data into M groups of sub-bit data in sequence, wherein each group of the sub-bit data includes (N/M)-bit data, M is a positive divisor of N, and M is not 1 or N; and driving, by adopting a corresponding driving voltage and corresponding driving time, a corresponding light-emitting unit to emit light, according to each group of the sub-bit data. By dividing raw N-bit data into M groups of sub-bit data, according to each group sub-bit data, the light-emitting unit is driven by the corresponding driving voltage and driving time. The original grayscale display is converted to be divided into M types of grayscale display, thereby increasing the number of gray levels of the light-emitting unit, increasing the brightness depth of the light-emitting unit, and meeting the requirements of high-level lighting for the grayscale depth.

The driving method, the driving circuit, and the display device provided by the embodiments of the present disclosure are described in detail above. Specific examples are used herein to explain the principles and implementations of the present disclosure. The description of the above embodiments is only used to help understand the method of the present disclosure and its core idea. Meanwhile, for those skilled in the art, there will be changes in the specific implementation and scope of the present disclosure, according to the idea of the present disclosure. In summary, the content of the present disclosure should not be understood as limitations on the present disclosure.

What is claimed is:

1. A driving method comprising steps:

acquiring driving data that comprises N-bit data;

dividing the N-bit data into M groups of sub-bit data in sequence, wherein each group of the sub-bit data comprises (N/M)-bit data, M is a positive divisor of N, and M is not 1 or N; and driving, by adopting a corresponding driving voltage and corresponding driving time, a corresponding light-emitting unit to emit light, according to each group of the sub-bit data.

2. The driving method as claimed in claim 1, wherein the step of dividing the N-bit data into M groups of sub-bit data in sequence comprises:

dividing each (N/M)-bit data in the N-bit data into one group of sub-bit data in order of bits from high to low; and sequentially denoting each of the divided groups of sub-bit data as first-level sub-bit data, second-level sub-bit data, . . . , and Mth-level sub-bit data.

3. The driving method as claimed in claim 2, wherein the driving time corresponding to the sub-bit data is shorter as a level corresponding to the sub-bit data is larger.

4. The driving method as claimed in claim 3, wherein the driving time corresponding to the first-level sub-bit data, the second-level sub-bit data, . . . , and the Mth-level sub-bit data are respectively P1, P2, . . . , and PM, and wherein P1, P2, . . . , and PM satisfy as:

$$P1:P2:\ldots:PM=2^{(M-1)}:2^{(M-2)}:\ldots:2^{0}.$$

5. The driving method as claimed in claim 4, wherein a sum of the driving time corresponding to the M groups of the sub-bit data is time of M frames.

6. The driving method as claimed in claim 1, wherein one of the groups of the sub-bit data corresponds to one of the driving voltage.

7. The driving method as claimed in claim 6, wherein the sub-bit data is selected from one of $2^{(N/M)}$ different data, and wherein the driving voltage corresponding to the sub-bit data is selected from one of $2^{(N/M)}$ driving voltages with different potentials.

8. The driving method as claimed in claim 7, wherein the potential of the driving voltage corresponding to the sub-bit data is higher as a binary value formed by (N/M) sub-bit of the sub-bit data is larger.

9. A driving circuit for implementing each step in the driving method as claimed in claim 1, wherein the driving circuit comprises a voltage output module and a light-emitting module, an output terminal of the voltage output module is connected to a driving voltage input terminal of the light-emitting module to output a corresponding driving voltage to the light-emitting module according to driving data that comprises N-bit data, and the voltage output module comprises:

$2^{(N/M)}$ output branches, in which an output terminal of any one of the output branches is connected to the driving voltage input terminal of the light-emitting module, and different output branches are configured to input different driving voltages to the light-emitting module, wherein M is a positive divisor of N and M is not 1 or N.

10. The driving circuit as claimed in claim 9, wherein the voltage output module comprises at least one original voltage input terminal, and the output branches are electrically connected to the original voltage input terminal.

11. The driving circuit as claimed in claim 10, wherein a quantity of the original voltage input terminals is only one, and the output branches comprise a first output branch, a second output branch, . . . , and a $2^{(N/M)}$th output branch, wherein the first output branch is directly connected to the original voltage input terminal, the second output branch is connected to the original voltage input terminal via a first resistor, . . . , and the $2^{(N/M)}$th output branch is connected to the original voltage input terminal via a series circuit of a $(2^{(N/M)}-1)$-th resistor, . . . , second resistor and the first resistor and is grounded.

12. The driving circuit as claimed in claim 10, wherein the quantity of the original voltage input terminals is $2^{(N/M)}$; the original voltage input terminals comprise a first original voltage input terminal, a second original voltage input terminal, . . . , and a $2^{(N/M)}$th original voltage input terminal; the output branches comprise a first output branch, a second output branch, . . . , and a $2^{(N/M)}$th output branch; the first output branch is directly connected to the first original voltage input terminal; the second output branch is directly connected to the second original voltage input terminal, . . . ; and the $2^{(N/M)}$th output branch is directly connected to the $2^{(N/M)}$th original voltage input terminal.

13. The driving circuit as claimed in claim 9, wherein each of the output branches comprises a switch control unit configured to control a conduction state of the output branch.

14. The driving circuit as claimed in claim 13, wherein the switch control unit is a DIP switch.

15. The driving circuit as claimed in claim 13, wherein the switch control unit comprises N/M switching transistors connected in series, one terminal of the switch control unit is electrically connected to the output terminal of the voltage output module, and the other terminal of the switch control unit is electrically connected to the original voltage input terminal.

16. The driving circuit as claimed in claim 15, wherein in any M/2 of the output branches, a gate of one of the switching transistors on each of the output branches is connected to a same gate control voltage.

17. The driving circuit as claimed in claim 9, wherein the light-emitting module comprises a charging unit, a driving unit, an energy storage unit, and a light-emitting unit, and the charging unit is electrically connected to the driving unit and the energy storage unit to write a data signal into the energy storage unit according to a scan signal;

the driving unit is electrically connected to the energy storage unit, the charging unit, and the light-emitting unit to drive the light-emitting unit to operate under control of the energy storage unit; and the energy storage unit is configured to store the data signal and control an operation state of the driving unit according to the data signal.

18. A display device comprising a driving circuit that comprises a voltage output module and a light-emitting module, wherein an output terminal of the voltage output module is connected to a driving voltage input terminal of the light-emitting module to output a corresponding driving voltage to the light-emitting module according to driving data that comprises N-bit data, and the voltage output module comprises:

$2^{(N/M)}$ output branches, in which an output terminal of any one of the output branches is connected to the driving voltage input terminal of the light-emitting module, and different output branches are configured to input different driving voltages to the light-emitting module, wherein M is a positive divisor of N and M is not 1 or N.

19. The display device as claimed in claim 18, wherein the voltage output module comprises at least one original voltage input terminal, and the output branches are electrically connected to the original voltage input terminal.

20. The display device of claim 18, wherein each of the output branches comprises a switch control unit configured to control a conduction state of the output branch.

* * * * *